United States Patent [19]

Manty

[11] 4,019,290

[45] Apr. 26, 1977

[54] GUTTER PROTECTOR

[75] Inventor: Bruce R. Manty, Moose Lake, Minn.

[73] Assignee: Lawrence Peska Associates, Inc., New York, N.Y. ; a part interest

[22] Filed: Dec. 23, 1975

[21] Appl. No.: 643,787

[52] U.S. Cl. ..... 52/11

[51] Int. Cl.[2] ..... E04D 13/00

[58] Field of Search ..... 248/48.1, 48.2; 52/16, 52/11, 12, 15

[56] References Cited

UNITED STATES PATENTS

| | | | |
|---|---|---|---|
| 538,108 | 4/1895 | Freeze | 52/11 |
| 984,716 | 2/1911 | Swisher | 248/48.1 |
| 1,141,204 | 6/1915 | Noce | 52/11 |
| 3,091,055 | 5/1963 | Hegedusich | 52/11 |
| 3,616,582 | 11/1971 | Walek | 248/48.1 |

*Primary Examiner*—John E. Murtagh

[57] ABSTRACT

A rain gutter is disclosed which can be deployed in an upward rain collecting position and downwardly in a discharge position as well as a storage position underneath the eaves of a house through hinge members attached to the gutter. A member is attached to the gutter which is operable from ground level to deploy the gutter either upwardly or downwardly and also to secure the gutter in an upward or downward position thereby eliminating the need of changing the upward or downward position of the gutter by using a ladder to reach the gutter. The gutter is especially useful in cold climates where gutters not only have to be cleaned but additionally have to be protected against ice and snow accumulation which tends to pull the gutter away from the side of the building and is also a source of wet rot since the accumulation of ice and snow directs water from a roof into the area behind the gutter.

1 Claim, 3 Drawing Figures

GUTTER PROTECTOR

SUMMARY OF THE INVENTION

The present invention relates to a rain gutter comprising a trough, a hinge mounted on the trough for hingedly securing the trough to the side of a building, a deployment member operatively connected to the trough for positioning the trough on the hinge either downwardly in relation to a building to discharge the contents of the trough and further to position the trough upwardly in a rain collecting position. The deployment member can be hingedly secured to the trough and is positionable to secure the trough downwardly and upwardly. In one embodiment the deployment member comprises a rod hingedly secured to the trough.

The rain gutter may be secured to the eaves of a building on a hinge that extends downwardly for a distance sufficient to swing the gutter down and underneath the eave of a building so that the gutter may be stored in this position to avoid the accumulation of snow and ice during winter months. When the gutter is changed from a rain collecting position to a storage position, it may also be cleaned of any accumulation of debris.

DETAILED DESCRIPTION

In order for rain gutters to function properly, debris such as leaves must be removed regularly and precautions must be taken during the winter months to prevent icing and excessive snow accumulation in them. If rain gutters are clogged either with debris such as leaves, ice or snow, water runs from the roof of a building into the ave structure around the gutter or in the immediate vicinity of the gutter and causes rotting. Additionally ice formed in the gutter or excessive snow accumulation tends to weaken the gutter especially where it is attached to a building and in some instances is the cause of gutters falling from buildings.

Devices are known in the prior art for emptying gutters such as those disclosed in U.S. Pat. Nos. 3,630,473 Landis and 3,091,055 Hegedusich. The former reference does not disclose apparatus adequate for completely emptying a rain gutter whereas the latter automatically empties by an intricate mechanism responsive to the weight of debris ice or snow in the guttter. The apparatus of the latter reference also is exposed to the elements and in wet freezing weather would become inoperative due to the accumulation of ice in the moving parts. Neither reference discloses apparatus for the maintenance of the gutters or the operation thereof in a manner that does not rely upon the use of a stepladder to reach the gutters. Furthermore none of the aforementioned references is suitable for storage underneath the eaves of a house during the winter months.

The prior art also discloses other gutter devices which are adjustable in relation to the roof and eaves of a building. However, all require the use of a ladder for changing their adjustment when the gutters are mounted a substantial distance above ground level. Examples of these references comprise U.S. Pat. Nos. 3,057,117 Singer; 2,625,353 Henry; 514,758 Lewis; 288,307 Campbell and 149,651 Gould.

It is therefore an object of the present invention to overcome these and other difficulties encountered in the prior art.

It is a further object of the present invention to provide a novel rain gutter mountable on the side of a building or specifically in the area of the eaves of a house a substantial distance above ground level and which can be deployed upwardly in a rain collecting position or downwardly in a discharge position or storage position without the need of having to make these adjustments from a stepladder.

These and other objects have been achieved according to the present invention and will become apparent by reference to the disclosure and claims that follow as well as the appended drawing.

Figure 1:
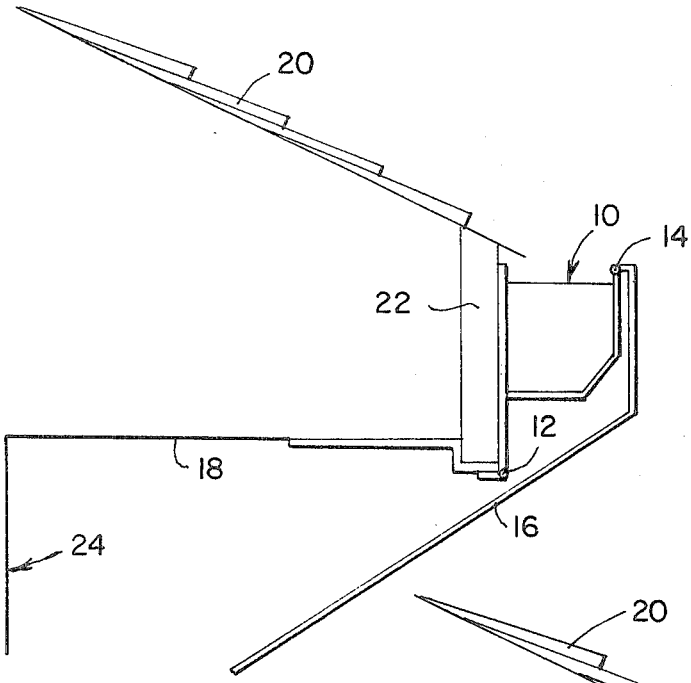
FIG. 1 is a side elevation illustrating the rain gutter in an upward fully deployed position according to one embodiment of the present invention.
Figure 2:
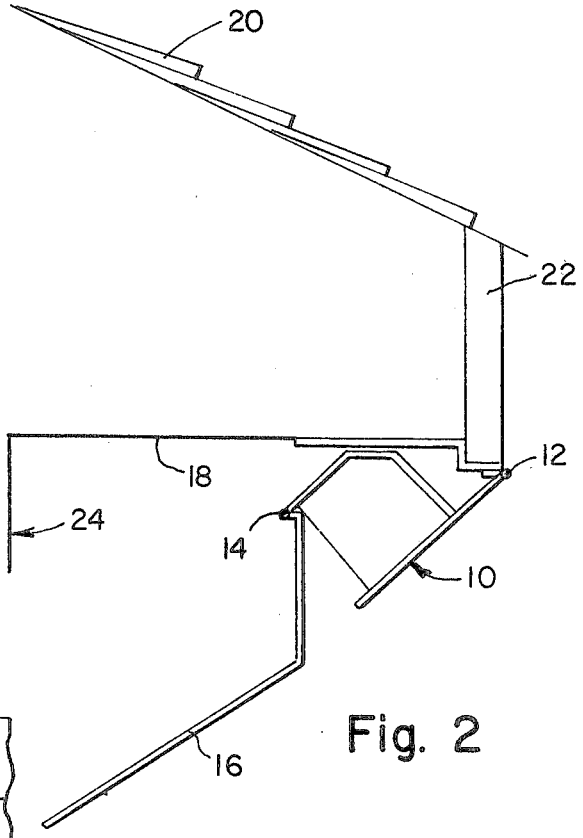
FIG. 2 is a side elevation illustrating the rain gutter in a downwardly deployed position and the storage position underneath the eave of a building according to another embodiment of the present invention.
Figure 3:
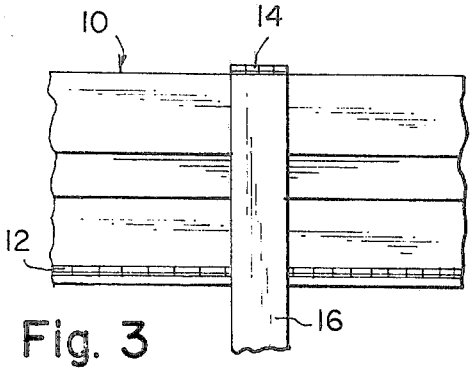
FIG. 3 is a front elevation in section illustrating the rain gutter and hinge for securing the gutter to the side of a building or an eave according to another embodiment of the present invention.

Referring to FIGS. 1 through 3 of the appended drawing, a rain gutter 10 is illustrated which comprises a trough having a hinge 12 extending beneath the trough 10, hinge 12 being secured to the side of a building 24, preferably in the area of the eave 18. A rod 16 is hingedly secured to the top front of the trough 10 through hinge 14 rod 16 being braced against the side of the building at or close to ground level so that rod 16 can be employed to hold trough 10 in an upright position to collect rain when the trough 10 is used during the summer months, rod 16 is also positionable to hold gutter or trough 10 by bracing rod 16 at or near ground level against the side of a building as illustrated in FIG. 2 to hold the gutter 10 in a downward position for either discharging debris such as accumulated leaves in trough 10 from the trough or for holding the trough in a storage position underneath the eaves 18 of a building for storage during the winter months so that ice and snow do not accumulate in the gutter which would lead to rotting or other deterioration of the facia trim board 22 and similar damage to the building in the area of eave 18 and the side of the building 24.

In use, water such as rainfall runs from the roof 20 into trough 10 and either down a downspout or away from the side of the building 24 sufficiently to protect the base of the building from excessive accumulations of water. During the winter months and at the end of the summer season, the trough 10 is deployed as illustrated in FIG. 2 to discharge any accumulated debris from the trough by pointing the trough in a downward direction and then bracing trough 10 in a storage position underneath the eave 18 of the building by holding or bracing rod 16 against the side of the building 24.

Although the invention has been described by reference to some embodiments, it is not intended that the novel rain gutter be limited thereby but that modifications thereof are intended to be included as falling within the broad spirit and scope of the foregoing disclosure, the following claims and the appended drawing.

What is claimed is:

1. A rain gutter comprising a trough positionable adjacent to the edge of a roof that extends over a building to form an eave, said trough being adopted to collect water flowing over such edge of a roof, the back of said trough being mountable on a facia trim board extending downward from such edge of a roof, a hinge having one arm extending in a direction from a point below said trough upwardly and secured to the back of said trough, said hinge having a second arm extending in a direction under such eave and towards a wall of a building on which said roof is mounted, said hinge being adapted to pivot at the intersection of such facie trim board and such eave, said one arm of said hinge being of a sufficient length so that said trough may be folded under such eave and so that the front edge of said trough is pointing at least towards such wall, a rod pivotally secured to the front edge of said trough for holding said trough in a rain collecting position under such roof edge and against such facia trim board, said rod also being operable to swing and hold said trough under such eave, said rod extending downwardly from said front edge of said trough and then at an angle towards said hinge.

* * * * *